US005535592A

United States Patent [19]

Mack

[11] Patent Number: 5,535,592

[45] Date of Patent: Jul. 16, 1996

[54] METHOD AND APPARATUS FOR FORMING A CLEAR FROZEN DRINKING VESSEL

[76] Inventor: Dominick Mack, 4200 Boardwalk & Roberts Ave., Wildwood, N.J. 08260

[21] Appl. No.: 260,704

[22] Filed: Jun. 16, 1994

[51] Int. Cl.[6] ..... F25C 1/18

[52] U.S. Cl. ..... 62/1; 62/308

[58] Field of Search ..... 62/1, 457.3, 308, 62/457.2; 426/515

[56] References Cited

U.S. PATENT DOCUMENTS

| | | | |
|---|---|---|---|
| 1,123,537 | 1/1915 | Huizer | 62/351 |
| 1,447,631 | 12/1923 | Deenihan | 62/349 X |
| 1,881,817 | 10/1932 | Meyer | 62/1 X |
| 1,991,384 | 2/1935 | Field et al. | 62/1 |
| 2,146,236 | 2/1939 | Stamp | 62/1 X |
| 2,536,217 | 1/1951 | Pownall | 62/1 |
| 2,952,133 | 9/1960 | Miller | 62/1 |
| 3,065,606 | 11/1962 | Reynolds | 62/1 |
| 3,091,194 | 5/1963 | Dickinson | 62/1 X |
| 4,188,906 | 2/1986 | Tachmindji et al. | 115/34 R |
| 4,505,121 | 3/1985 | Gram | 62/60 |
| 4,550,575 | 11/1985 | DeGaynor | 62/308 |
| 4,625,518 | 12/1986 | Freedman | 62/1 |
| 4,685,304 | 8/1987 | Essig | 62/68 |
| 5,013,562 | 5/1991 | Somura | 426/66 |
| 5,177,981 | 1/1993 | Haas | 62/457.3 |
| 5,250,315 | 10/1993 | Loew et al. | 426/524 |
| 5,354,457 | 10/1994 | Beahi | 210/170 |

*Primary Examiner*—Henry A. Bennett
*Assistant Examiner*—William C. Doerrler
*Attorney, Agent, or Firm*—Mathews, Woodbridge & Collins

[57] ABSTRACT

The present invention relates to a method and apparatus for forming a drinking vessel which is substantially free of contaminants. A consumable liquid is added to a container. The liquid is stirred while freezing the liquid allowing contaminants to flow towards the center of the liquid. A layer of ice forms on the inside of the container which is substantially free of contaminants to form the drinking vessel. In one embodiment, gas is bubbled into the liquid for stirring the liquid. Alternatively, a propeller can be used to agitate the liquid.

5 Claims, 4 Drawing Sheets

METHOD AND APPARATUS FOR FORMING A CLEAR FROZEN DRINKING VESSEL

1. Field of the Invention

The present invention relates to a clear drinking vessel and a method and apparatus for forming the drinking vessel in which the vessel is substantially free of contaminants.

2. Background of the Invention

Drinking vessels formed of ice for chilling and holding liquids are known. U.S. Pat. No. 1,123,537 describes an apparatus for the manufacture of a drinking vessel made of ice. The apparatus includes a conical mold and a conical core. The conical core has greater conicity than the mold. A body of liquid is introduced between the mold and the core and is subjected to refrigeration. A piston can be used to remove the formed drinking vessel from the mold.

U.S. Pat. No. 4,625,518 describes a method and apparatus for forming an ice mug in which the ice mug includes a frozen handle secured thereto. A mold has a shaped interior baffle. The mold is filled with a consumable liquid. The liquid is frozen to form a frozen container. Thereafter, the container is released from the mold. A handle is embedded into the container by heating a portion of the sidewalls of the container, inserting the handle into the heated portion and refreezing the melted area. The above-described patents have the drawback that any contaminants in the liquid become part of the frozen container. The contaminants can be released into a liquid contained in the container when the inside of the container melts and the contaminants also can give the mug a non-clear appearance.

U.S. Pat. No. 3,065,606 relates to a drinking cup having an outer cup of an insulating material and a layer of ice within the outer cup. An inner lining lines the inner surface of the ice to prevent melting ice from diluting the beverage contained in the cup and weakening the content of the beverage. This patent has the limitation of requiring additional materials for forming the ice mug which can increase costs of the manufacture and must be disposed of after use.

Of possible general relevance are U.S. Pat. Nos. 4,505,121; 3,091,194 and 2,952,133.

SUMMARY OF THE INVENTION

Briefly described the present invention comprises a method and apparatus for forming a drinking vessel in which the drinking vessel is substantially free of contaminants. It is known that pure water, which is free from impurities, will freeze before unpure water. It is also known that a body of water freezes from the outside edge surfaces towards the center of the body. Accordingly, during freezing, impurities in the water will move towards the warmth of the center of the body and flow away from the outside edge surfaces. Thus, the movement of impurities allows purer water to freeze at the outside edge surface of the body of water. The method and apparatus of the present invention provide movement of the water during freezing for allowing the impurities to flow towards the center of the body of water.

The method includes the steps of adding a consumable liquid to a container. Thereafter, the liquid is stirred during freezing of the liquid for drawing the impurities towards the center of the liquid. A layer of ice forms on the inside surface of the container which is substantially free of contaminants and forms the drinking vessel. In one embodiment, the stirring step is performed by bubbling a gas into the center portion of the liquid. In an alternative embodiment, the stirring step is performed by agitating the liquid with a propeller. Alternatively, the liquid can be stirred by both the propeller and bubbling gas through the blades of the propeller.

A drinking vessel is formed by the present invention in which side walls are coupled to a bottom and the side walls and bottom are optically clear and substantially free of contaminants.

The present invention will be more fully described by reference to the following drawings.

DETAILED DESCRIPTION OF THE INVENTION

During the course of this description like numbers will be used to identify like elements according to the different figures which illustrate the invention.

Figure 1A:
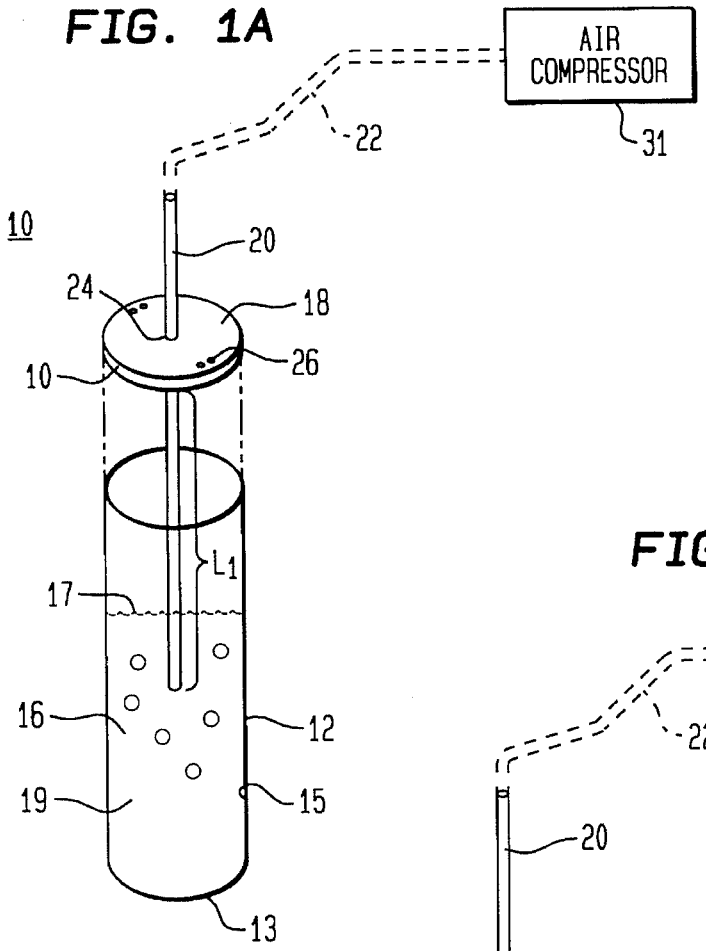
FIG. 1A is a perspective view of the apparatus for forming a drinking vessel of the present invention.
Figure 1B:
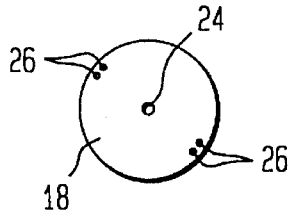
FIG. 1B is a top plan view of the apparatus of FIG. 1A.

FIGS. 1A and 1B illustrate an apparatus for forming a drinking vessel 10 in accordance with the teachings of the present invention. A container 12 is formed of bottom 13 and sidewalls 14. Water 16 is received in inside portion 15 of container 12. Water 16 can be from any source. For example, water 16 can be tap water, spring water or mineral water.

Container 12 has a predetermined size for forming a predetermined sized drinking vessel. Preferably, container 12 has a cylindrical shape and is about 4 inches in diameter and 11 inches high for forming a conventional size drinking vessel. It will be appreciated that various shaped and sized containers can be used for forming different shapes and sizes of drinking vessels. Container 12 can be formed of stainless steel aluminum or food grade plastic. Container 12 can have a thickness of a gauge of about ⅙th of an inch. It will be appreciated that the container can be formed of other materials known in the art of food processing.

A sufficient amount of water is added to container 12 for forming the predetermined sized drinking vessel. Preferably, container 12 is filled to about ¾ to about ⅞ full with water 16.

Container top 18 is placed on top of container 12. Gas inlet tube 20 is received in aperture 24 of container top 18. Container top 18 holds gas inlet tube 20 in place within container 12. Gas inlet tube 20 has a predetermined length $L_1$ for extending the tube a predetermined depth into water 16. Gas inlet tube 20 preferably extends ¾ of the length of container 12 into water 16 and is about 2 to about 3 ¼ inches from bottom 13 of container 12. Gas source tube 22 is coupled to gas inlet tube 20 and gas source 31 for providing gaseous bubbles 21 to water 12. Preferably, gaseous bubbles 21 are formed of air. Gas source 31 provides pressurized gas. Gas inlet tube 20 is preferably solid and can be formed of a plastic or a metal material. Gas source tube 22 can be formed of a flexible or solid tube. Gas flows from gas source 31 through gas source tube 22 and gas inlet tube 20 into water 16. Vents 26 are formed in container top 18 for allowing air generated in container 12 to escape.

The flow of gas into water 16 constantly agitates water 16 for allowing impurities in water 16 to flow towards the center portion 17 of container 12. Water 16 in center portion 17 of container 12 is typically warmer than water at edge portion 19 of a container 12 and impurities flow towards the warmer water. Water which freezes at edge portion 19 is substantially free of contaminants and forms optically clear ice. Examples of impurities which can be removed are minerals, sodium, fluoride and the like.

Figure 2:
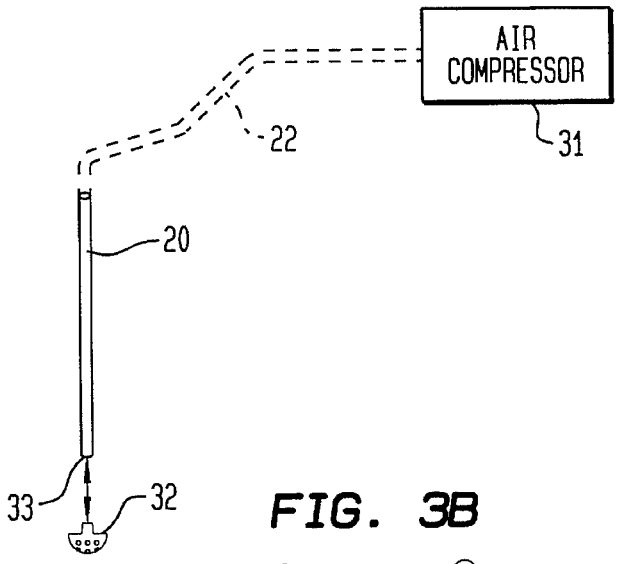
FIG. 2 is a front elevational view of tubing and a flow regulator used in the apparatus shown in FIG. 1A.
Figure 3A:
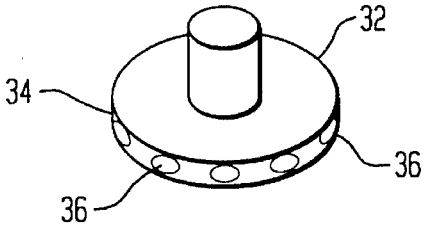
FIG. 3A is a front elevational view of the flow regulator.
Figure 3B:
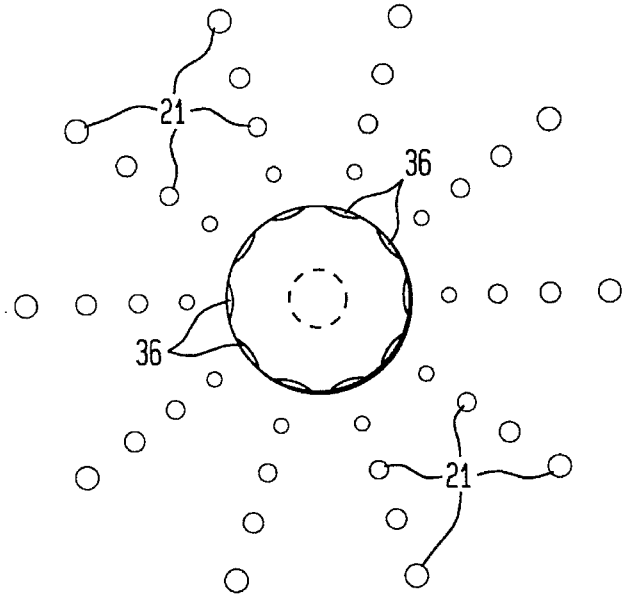
FIG. 3B is a top plan view of the flow regulator.

Flow regulator 32 can be attached to end 33 of gas inlet tube 20, as shown in FIGS. 2 and 3. Holes 36 are formed in the outside surface 34 of flow regulator 32. Flow regulator 32 provides an even flow of bubbles 21 from gas inlet tube 20 to water 16.

Figure 4A:
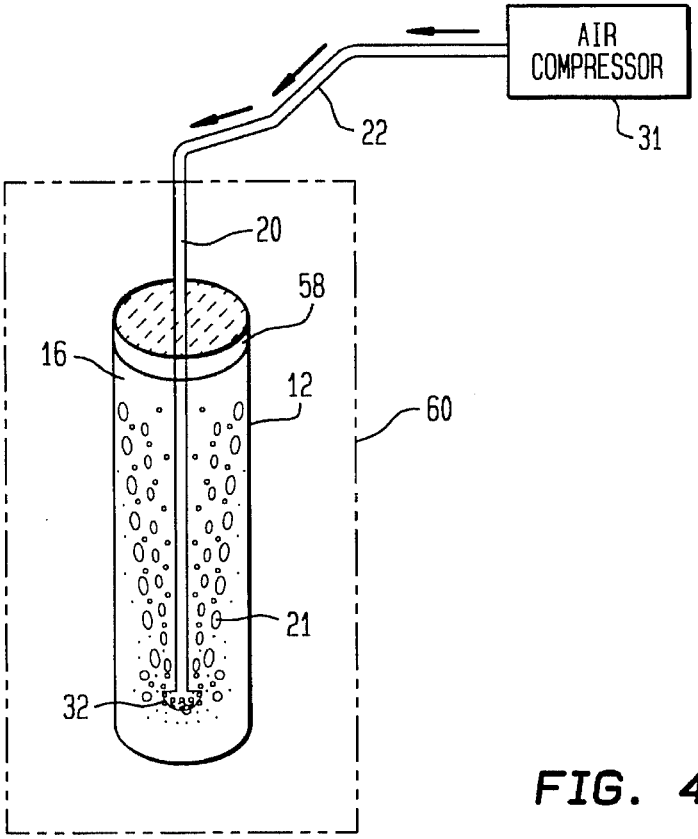
FIG. 4A is a perspective view of the apparatus in combination with a freezing solution.
Figure 4B:
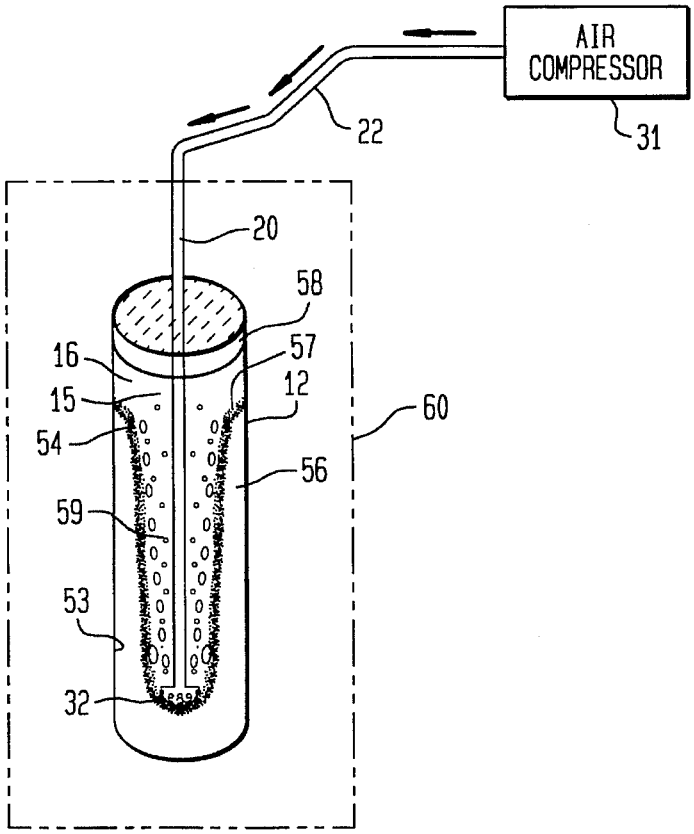
FIG. 4B is a perspective view of the apparatus after formation of a layer of ice in the apparatus.

FIG. 4A is a perspective view of apparatus 10 during freezing of water 16 within container 12. Container 12 is placed within a conventional freezing unit 60. The freezing environment is below 32° F. for freezing water 16. Preferably, freezing unit 60 is at a temperature between about (–)8° F. to about 5° F. During freezing, a layer of ice 54 forms along inside surface 53 of container 12 as shown in FIG. 4B. Upon continued freezing, the layer of ice 54 increases in thickness towards center portion 15 of container 12. The volume of water 16 within center portion 15 decreases as layer of ice 54 is formed. The freezing process is stopped after layer of ice 54 reaches a predetermined thickness. Preferably, container top 18 has an insulated rim 58 for preventing container top 18 from freezing to the top 57 of formed drinking vessel 56.

The amount of time container 12 is placed in freezing unit 60 is dependent on the temperature of freezing unit 60 and the desired thickness of layer of ice 54 of drinking vessel 56. The colder the atmosphere in the freezing unit 60 the faster the formation of drinking vessel 56. In a colder environment, preferably additional bubbles are used in order to keep agitating water 16, thereby allowing impurities 55 to flow towards center portion 17 of container 12. Water 16 with impurities 55 remains in the inside portion of formed drinking vessel 56.

Figure 5:
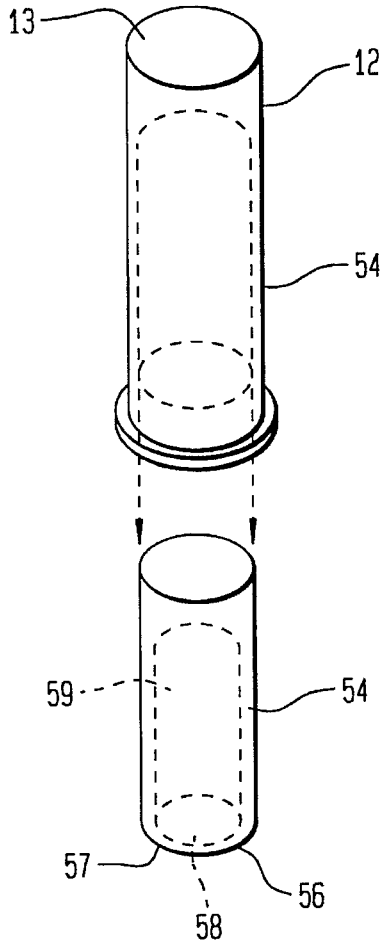
FIG. 5 is a perspective view of the removal of a formed drinking vessel from a container.

After formation of drinking vessel 56, container 12 is removed from freezing unit 60. Container 12 is turned upside down for removing drinking vessel 56 from container 12, as shown in FIG. 5. Water 16 with impurities 55 flows from drinking vessel 56. Drinking vessel 56 includes opening 58 and cavity 59. Top 57 of drinking vessel 56 may be uneven. Conventional ironing, sanding or sawing processes can be used to form an even top 57 of drinking vessel 56.

Figure 6:
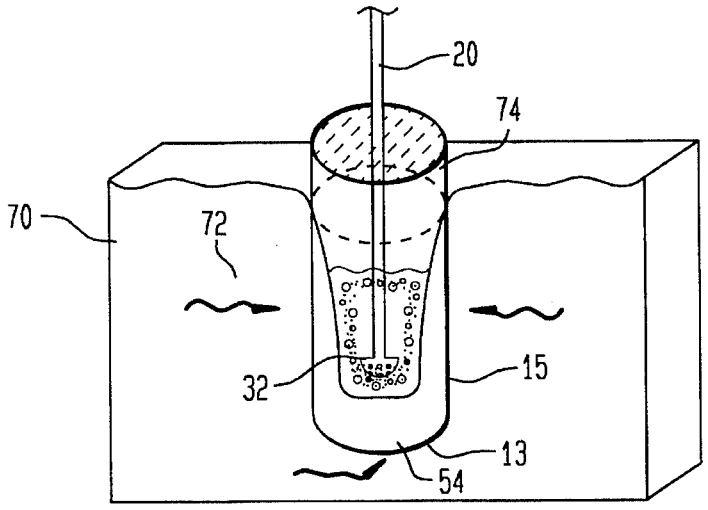
FIG. 6 is a perspective view of an alternative embodiment of the freezer environment.

FIG. 6 is a perspective view of a second embodiment of the freezing environment in which container 12 is placed in container 70. Container 70 is filled with freezing solution 72. Preferably, freezing solution 72 circulates within container 70 for evenly contacting container 12. Freezing solution 72 is preferably non-toxic. Examples of freezing solutions 72 useful for practice of the present invention are a brine solution formed of salt water, and propylene glycol.

Freezing solution 72 surrounds side wall 14 and bottom 13 of container 12. Top portion 74 of container 12 is not submerged in freezing solution 72. In this embodiment, container top 18 is not exposed to freezing temperatures and will not freeze to container 12. It will be appreciated that other freezing environments can be used for forming drinking vessel 56.

Figure 7:
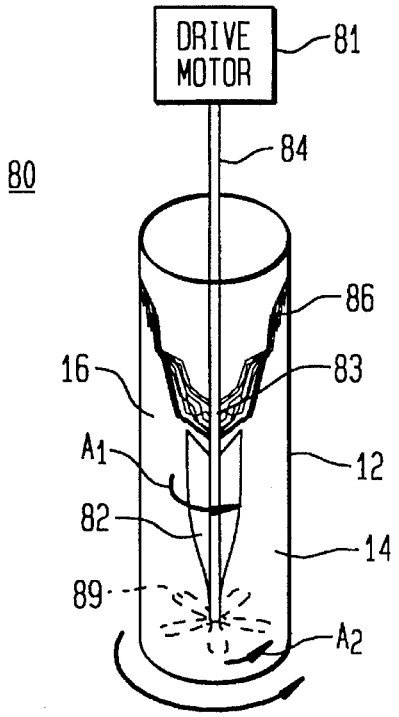
FIG. 7 is a perspective view of an alternate embodiment of the present invention with a rotating propeller blade.

FIG. 7 is a perspective view of an alternative embodiment of apparatus 10 including propeller system 80. Drive motor shaft 84 is positioned within container 12. Motor 81 rotates drive motor shaft 84. Propeller fin 82 is positioned at end 83 of drive motor shaft 84. Rotation of propeller fin 82 in the direction of arrow $A_1$ provides flow of water 16 in the direction of arrow $A_2$ for forming a whirlpool 86 in container 12. The use of a propeller has the advantage of reducing the chances of air bubbles being frozen in the formed drinking vessel, thereby providing for improved integrity of the ice.

Figure 8:
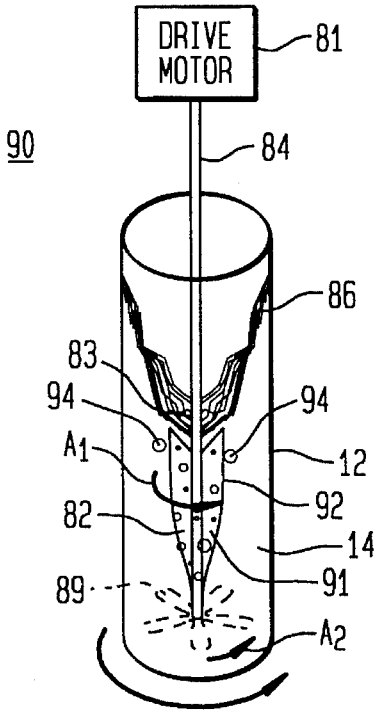
FIG. 8 is a perspective view of an alternate embodiment of the rotating propeller blade including holes for gas bubbles.

An alternative embodiment of agitator propeller system 90 is shown in FIG. 8. Holes 92 are formed on the outside surface 91 of propeller fin 82. Drive motor shaft 84 is powered by air which emerges as air bubbles 94 from holes 92 into water 16. Agitator propeller system 90 provides agitation of water 16 by propeller fin 82 and air bubbles 94.

The above described apparatus produces a drinking vessel which extracts at least about 95% of impurities from the drinking vessel for producing a drinking vessel which is substantially free of contaminants. The drinking vessel has the advantage that the removal of contaminants produces an optically clear drinking vessel for allowing a user to see the substance within the vessel. In addition, melting of the inside of the vessel during use of the vessel will not result in any contaminants being released into the consumable liquid held within the vessel.

While the invention has been described with reference to the preferred embodiment, this description is not intended to be limiting. It will be appreciated by those of ordinary skill in the art that modifications may be made without departing from the spirit and scope of the invention.

I claim:

1. A method for forming a drinking vessel comprising the steps of:

adding a consumable liquid to a container;

stirring said liquid in said container by agitating said liquid in said container with a propeller having a plurality of holes therein and an air source for bubbling a gas through said holes in said propeller; and freezing said liquid during said stirring step for forming a layer of ice adjacent the inside surface of said container to form said drinking vessel, wherein said drinking vessel is substantially free of contaminants.

2. A clear drinking vessel formed by the method of claim 1.

3. An apparatus for forming a drinking vessel comprising:

liquid container means for holding a consumable liquid;

a propeller for constantly stirring said liquid in said container;

a plurality of holes in said propeller and an air source for bubbling a gas through said holes in said propeller;

a motor for rotating said propeller, said rotating propeller agitates said liquid; and freezing means for freezing said liquid during stirring of said liquid, said liquid forming a wall of ice adjacent the inside surface of said liquid container means, said formed wall of ice forming said drinking vessel in said liquid container means, wherein said formed drinking vessel is substantially free of contaminants.

4. The apparatus of claim 3 wherein said freezing means comprises:

a freezing container means;

a freezing solution contained within said freezing container means;

circulation means for circulating said freezing solution;

wherein said liquid container means is placed in said freezing container means.

5. The apparatus of claim 4 wherein said freezing solution is selected from the group consisting of a brine salt water solution and propylene glycol.

* * * * *